US006918732B2

(12) United States Patent
Jendroska et al.

(10) Patent No.: US 6,918,732 B2
(45) Date of Patent: Jul. 19, 2005

(54) CHANGING STATION FOR PRINTING MACHINES

(75) Inventors: Rainer Jendroska, Greven (DE); Alois Thoele, Lienen (DE)

(73) Assignee: Windmoeller & Hoelscher KG, Lengerich (DE)

( * ) Notice: Subject to any disclaimer, the term of this patent is extended or adjusted under 35 U.S.C. 154(b) by 46 days.

(21) Appl. No.: 10/097,856

(22) Filed: Mar. 15, 2002

(65) Prior Publication Data

US 2002/0129720 A1 Sep. 19, 2002

(30) Foreign Application Priority Data

Mar. 15, 2001 (DE) ..... 101 12 522

(51) Int. Cl.[7] ..... B65H 54/26

(52) U.S. Cl. ..... 414/331.14; 414/495; 414/331.11; 414/608

(58) Field of Search ..... 414/331.01, 331.06, 414/331.07, 331.11, 331.14, 396, 391, 422, 608, 679, 609, 910, 911; 366/213

(56) References Cited

U.S. PATENT DOCUMENTS

| | | | | | |
|---|---|---|---|---|---|
| 3,773,191 | A | * | 11/1973 | Ishida | 57/276 |
| 5,333,988 | A | * | 8/1994 | Turra et al. | 414/795.8 |
| 5,480,187 | A | * | 1/1996 | Binning | 280/79.2 |
| 5,516,207 | A | * | 5/1996 | Haicht | 366/213 |
| 5,562,385 | A | * | 10/1996 | Tacchi et al. | 414/391 |
| 5,715,749 | A | | 2/1998 | Miller | 101/216 |
| 6,077,025 | A | * | 6/2000 | Budd et al. | 414/546 |
| 6,579,053 | B1 | * | 6/2003 | Grams et al. | 414/269 |

FOREIGN PATENT DOCUMENTS

EP 0 491 592 6/1992

* cited by examiner

*Primary Examiner*—Eileen D. Lillis
*Assistant Examiner*—Charles A. Fox
(74) *Attorney, Agent, or Firm*—Jacobson Holman PLLC

(57) ABSTRACT

A changing station for sleeves of printing machines with a lifting platform, disposed on the side of the printing machine, and with a wagon, in which a vertically adjustable shelf with carrying mandrels for receiving sleeves is received, whereby the shelf can be coupled to the lifting platform for joint lifting and lowering while the wagon remains on the ground.

16 Claims, 2 Drawing Sheets

CHANGING STATION FOR PRINTING MACHINES

BACKGROUND OF THE INVENTION

1. Field of the Invention

The invention relates to a changing station for sleeves of printing machines.

2. Description of the Related Art

The operation of printing machines requires that the printing sleeves or engraved roller sleeves have to be changed. In the case of larger printing machines the printing sleeves can exhibit a weight of approximately 20 kg. The operating personnel must change these printing sleeves manually, whereby the respective sleeve mandrel inside the printing machine can be reached only by means of a ladder. Thus, such a changing of the sleeves is troublesome for the operating personnel and subject to accidents.

SUMMARY OF THE INVENTION

The object of the present invention is to provide a changing station for sleeves that makes it easier for the operating personnel to change the sleeves in printing machines.

The invention solves this problem by a combination of features, including a changing station for sleeves of printing machines, in which a lifting platform, on which the operating personnel stands for the purpose of changing the sleeves, is provided at the side of the printing machine.

Furthermore, a wagon is a component of the changing station, in which a vertically adjustable shelf with carrying mandrels for receiving the sleeves is accommodated, whereby the shelf can be coupled to the lifting platform for joint lifting and lowering.

This changing station gives the operating personnel the possibility of handling in a safe and simple manner the sleeves in a plane between the printing machine and the shelf, which exhibits carrying mandrels and is disposed in the same plane. It is especially advantageous that all sleeves can be received immediately in the changing station so that there is no need to climb the ladder with great effort after depositing each sleeve. The changing station makes it possible to change the sleeves much faster and with greater ease and without danger.

Especially advantageous designs of the changing station, according to the invention, are disclosed in the dependent claims.

It follows that the lifting platform can exhibit a front and two side protective gates, whereby at least one of the side protective gates is designed as a folding door. Thus, the safety requirements for the operating personnel are met.

The lifting platform can be raised and lowered advantageously by means of a motor-driven scissor lift.

The wagon is enclosed advantageously on three sides and open in the direction of one side, whereby the shelf receiving the carrying mandrels is oriented in such a manner in the wagon that the carrying mandrels can be attended from the open side of the wagon. The wagon can be open at the top; and the vertically adjustable shelf can be mounted in the wagon so as to be vertically adjustable by means of slide bearings.

Finally the shelf can be made of a structural steel beam, whereby this structural steel beam can be coupled to the front protective gate of the lifting platform by means of a coupling mechanism. The coupling mechanism comprises advantageously journals, which engage with an opposing journal receptacle.

It is also advantageous to dispose on the front protective gate of the lifting platform additionally support brackets, against which at least one support of the shelf is braced in the coupled state.

The wagon can be mounted, according to a preferred design variant, on rollers, which can be locked by means of locking brakes.

Other details and advantages of the invention are explained in detail with reference to the embodiment depicted in the drawings.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
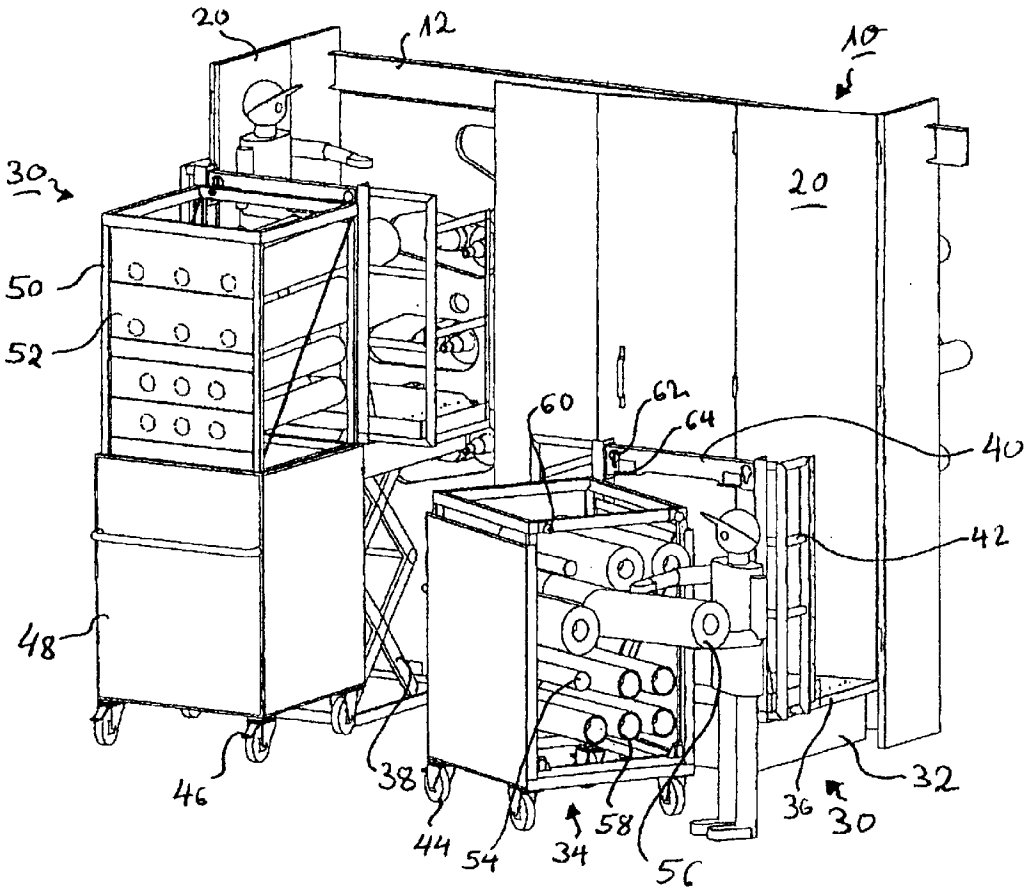
FIG. 1 is a perspective view of the inventive changing station in different working positions.
Figure 2:
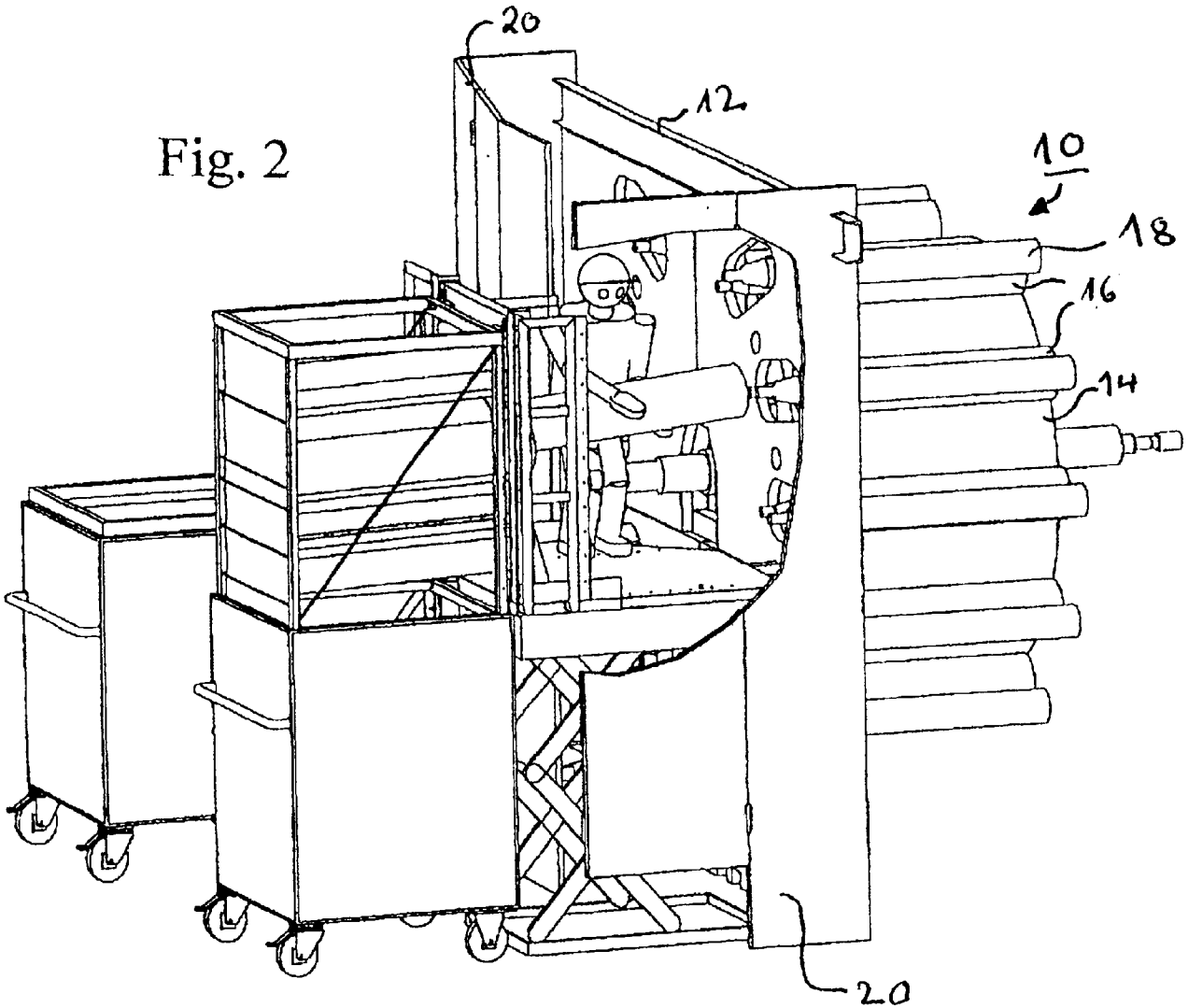
FIG. 2 is a perspective view of the changing station, according to FIG. 1, at a different viewing angle and in a different working position of the respectively illustrated changing stations.

In FIG. 2 the reference numeral 10 refers to a part of a printing machine, whereby a row of printing rollers 16 or engraved rollers 18 are disposed in the known manner around a counter pressure cylinder 14 in a support frame 12, which is only partially shown here. The printing machine can be closed by means of folding doors 20 on the side, whereby the drawings, according to FIG. 2 and/or FIG. 1, show the folding doors in different folding positions.

FIGS. 1 and 2 show two changing stations 30 in different positions next to the printing machine. The changing stations comprise in essence a lifting platform 32 and a wagon 34.

The lifting platform 32 exhibits a floor 36, which can be moved by means of a scissor lift 38. The scissor lift 38 is moved by means of a motor, which is not shown in detail here. On the floor 36 is a front protective gate 40 and two side protective gates 42, both of which can be folded open.

The wagon 34 can be driven on rollers 44, whereby the rollers 44 exhibit locking brakes 46, which are foot operated so as to lock the rollers 44. The wagon exhibits walls 48 on three sides. Inside the walls is a shelf 50, which is made of a welded structural steel beam and can be vertically adjusted by means of slide bearings, which are not shown in detail here. The rear side 52 of the shelf has a total of twelve mandrels 54 so that, as shown in FIG. 1, they are accessible to the operating personnel from the open side of the wagon 34. FIG. 1 shows in the wagon depicted in the lowered position on the right hand side how a printing sleeve 56 is being removed. Below the printing sleeves, the engraved roller sleeves 58 are slid onto the mandrels 54.

The wagon 34 can be coupled to the lifting platform 30 so that the shelf 50 can be raised and lowered together with the lifting platform. The coupling is effected by means of two journals 60, which are disposed at the uppermost support of the shelf 50 and which can be inserted into journal receptacles 62 at the front protective gate 40 of the lifting platform 30. Finally there are on the front protective gate 40 two support brackets 64, which support from below the corresponding support of the shelf after the journals 60 have been coupled into the journal receptacle 62.

Thus, as the lifting platform 30 is raised and lowered, so can the shelf 50 of the wagon 34 be simultaneously raised and lowered.

FIG. 1 shows on the right hand side how a printing sleeve 56 is being removed. Here the wagon 34 is uncoupled from the lifting platform 30, and the shelf 50 is moved into the wagon into its lowest position. In contrast, on the left hand side of FIG. 1, the shelf 50 of the wagon 34 is coupled to the lifting platform 30. The shelf and the sleeves are raised together with the lifting platform so that the operating personnel can now change the sleeves. When fitting the mandrels of the shelf, one mandrel is left free, on the one hand, for the engraved roller sleeves and, on the other hand, for the printing sleeves so that the sleeves can be changed in succession in one operation by the operating personnel. The number of mandrels, depicted in the design according to FIG. 1, is reproduced here only as an illustration. Of course, an arbitrary number of mandrels can be disposed on the shelf.

The right hand side of FIG. 2 shows a wagon 34 with the shelf 50 moved to the top, whereby a printing sleeve 56 is being removed from the shelf. On the left hand side a wagon 34 is depicted in the lowered and uncoupled position.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A changing station for sleeves of a printing machine comprising a lifting platform, disposed on a side of the printing machine, and a detached wagon in which a vertically adjustable shelf is received, said shelf including a generally rectangular metal frame defining an interior space and sized to fit within said wagon when said shelf is in a lowered position relative thereto, a rear side of said frame having a plurality of carrying mandrels extending inwardly into said interior space for receiving sleeves, said shelf being detachably coupled to a side of the lifting platform such that, when detached the shelf and wagon are movable independently of said lifting platform while, when coupled to said side thereof, the shelf is lifted and lowered together with said lifting platform while said wagon stays on the ground.

2. The changing station for sleeves, as claimed in claim 1, wherein the lifting platform exhibits a front protective gate and two side protective gates, whereby at least one of the side protective gates is designed as a folding door.

3. The changing station for sleeves, as claimed in claim 1, wherein the lifting platform is raised and lowered by means of a motor-driven scissor lift.

4. The changing station for sleeves, as claimed in claim 1, wherein the wagon is enclosed on three sides and open on one side, the shelf with the carrying mandrels being aligned in such a manner in the wagon that the carrying mandrels can be attended from the open side of the wagon.

5. The changing station for sleeves, as claimed in claim 1, wherein the vertically adjustable shelf is mounted in the wagon so as to be vertically movable along slide bearings.

6. The changing station, as claimed in claim 2, wherein the shelf frame is made of a structural steel beam coupled to the front protective gate of the lifting platform by means of a coupling mechanism.

7. The changing station, as claimed in claim 6, wherein the coupling mechanism comprises journals which engage with an opposing journal receptacle.

8. The changing station for sleeves, as claimed in claim 7, wherein on the front protective gate of the lifting platform there are additionally support brackets, against which at least one support of the shelf is braced in the coupled state.

9. The changing station, as claimed in claim 1, wherein the wagon is mounted on rollers, which can be locked by means of locking brakes.

10. A changing station for sleeves of a printing machine comprising a lifting platform, disposed on a side of the printing machine, and a wagon having an open side and a plurality of vertically extending walls and being movable separately from said lifting platform, said wagon being directly coupled to a vertically adjustable shelf that has carrying mandrels for receiving sleeves, said shelf being movable from a nested position in which the mandrels are partially enclosed by the walls of said wagon while being accessible through said open side, to a vertically extended position in which the shelf extends upwardly beyond the walls of the wagon while remaining coupled to said wagon, said shelf, when said wagon is moved adjacent said lifting platform, being detachably coupled to a side of the lifting platform such that the shelf is lifted and lowered together with said lifting platform while said wagon stays on the ground.

11. The changing station for sleeves, as claimed in claim 10, wherein the lifting platform includes a front protective gate to which said shelf is coupled.

12. The changing station for sleeves, as claimed in claim 10, wherein the wagon is enclosed on three sides by said vertically extending walls.

13. The changing station, as claimed in claim 11, wherein the shelf includes a generally rectangular frame having a structural steel beam coupled to the front protective gate of the lifting platform by means of a coupling mechanism.

14. The changing station, as claimed in claim 13, wherein the coupling mechanism includes journals which engage with an opposing journal receptacle.

15. The changing station for sleeves, as claimed in claim 14, wherein on the front protective gate of the lifting platform there are additionally support brackets, against which at least one support of the shelf is braced in the coupled state.

16. A changing station for sleeves of a printing machine comprising a lifting platform, disposed on a side of the printing machine, and a wagon in which a vertically adjustable shelf with carrying mandrels for receiving sleeves is received, said shelf being detachably coupled to a front protective gate of the lifting platform by a coupling mechanism for joint lifting and lowering, the front protective gate of the lifting platform also including support brackets against which at least one support of the shelf is braced in the coupled state.

* * * * *